US005933070A

United States Patent [19]

Hasebe et al.

[11] Patent Number: 5,933,070

[45] **Date of Patent: *Aug. 3, 1999**

[54] HIGH-VOLTAGE VARIABLE RESISTOR

[75] Inventors: Hironobu Hasebe, Takaoka; Kazufumi Daimon, Namerikawa, both of Japan

[73] Assignee: Hokuriku Electric Industry Co., Ltd., Toyama, Japan

[ * ] Notice: This patent is subject to a terminal disclaimer.

[21] Appl. No.: 08/963,969

[22] Filed: Nov. 4, 1997

Related U.S. Application Data

[62] Division of application No. 08/579,104, Dec. 27, 1995, Pat. No. 5,726,625.

[30] Foreign Application Priority Data

Dec. 28, 1994 [JP] Japan ..... 6-327207

[51] Int. Cl.[6] ..... H01C 10/32

[52] U.S. Cl. ..... 338/162; 338/202; 338/174; 338/187

[58] Field of Search ..... 338/162, 163, 338/160, 166–168, 174, 187, 188, 190, 202

[56] References Cited

U.S. PATENT DOCUMENTS

| | | | |
|---|---|---|---|
| 2,454,816 | 11/1948 | Levy | 338/147 |
| 3,512,113 | 5/1970 | Kirkenkdall | 338/163 |
| 3,601,743 | 8/1971 | Mathison | 338/164 |
| 3,639,878 | 2/1972 | Scheel | 338/174 |
| 3,696,318 | 10/1972 | Mack | 338/162 |
| 3,772,630 | 11/1973 | Falco | 338/174 |
| 4,344,063 | 8/1982 | Nishimoto et al. | 338/160 |
| 4,635,028 | 1/1987 | Oelsch et al. | 338/171 |
| 4,835,511 | 5/1989 | Henmi | 338/174 |
| 4,884,052 | 11/1989 | Eitoku et al. | 338/202 |
| 5,500,634 | 3/1996 | Ueda | 338/174 |
| 5,726,625 | 3/1998 | Hasebe et al. | 338/162 |

*Primary Examiner*—Michael L. Geliner
*Assistant Examiner*—Karl Easthom
*Attorney, Agent, or Firm*—Pearne, Gordon, McCoy & Granger LLP

[57] ABSTRACT

A high-voltage variable resistor capable of significantly small-sizing a circuit board as compared with the prior art. A terminal fitment is provided so as to act as an electrical connector for establishing electrical connection between a slide element fixed on an operation shaft member and slid on a variable resistance pattern formed on a circuit board and an output portion thereof. The terminal fitment includes a contact holding portion which is provided at a distal end thereof with a contact portion. A contact point between the contact portion of the terminal fitment and a contact portion of the slide element is defined on a side of the operation shaft member while being spaced from a front surface of the circuit board. Such construction prevents the contact point from being defined at a central portion of the variable resistance pattern, resulting in a radius of curvature of the variable resistance pattern being reduced as compared with that in the prior art.

1 Claim, 6 Drawing Sheets

HIGH-VOLTAGE VARIABLE RESISTOR

This is a division of application Ser. No. 08/579,104, filed Dec. 27, 1995 now U.S. Pat. No. 5,726,625.

BACKGROUND OF THE INVENTION

This invention relates to a high-voltage variable resistor.

A conventional high-voltage variable resistor commonly called a focus pack which is capable of variably outputting a focus voltage and a screen voltage generally includes a circuit board generally constructed as shown in FIG. 6A. More particularly, a circuit board generally designated at reference numeral 101 in FIG. 2A has a circuit pattern 102 formed on a front surface thereof by printing. The circuit pattern includes an input electrode E1, a focus voltage output electrode E2, a screen voltage output electrode E3, a ground electrode E4, a first variable resistance pattern VR1 for adjustment or variation of a screen voltage, and a second variable resistance pattern VR2 for adjustment or variation of a screen voltage. Also, the circuit pattern 102 includes connection patterns CP1 and CP2 each acting as an electrical connection means which is contacted with a slide element (not shown) to establish electrical connection between the slide element and the output electrodes E1 and E2. The slide element includes a slide contact slid on the variable resistance patterns VR1 and VR2 and a contact rotated on ends CP11 and CP12 of the connection patterns CP1 and CP2.

A size of the high-voltage variable resistor generally depends on an area of the circuit board 101, of which a size depends on the circuit pattern 102. In determination of a size of the circuit board 101, a distance between each adjacent two of sections of the circuit pattern 102 is determined in view of so-called pattern dielectric strength (normally, 1 mm/1 kV) capable of preventing occurrence of discharge. Thus, a distance A between the variable resistance patterns VR1 and VR2 and the ends CP11 and CP12 of the connection patterns CP1 and CP2 is likewise regulated by the pattern dielectric strength. Thus, it is required to increase a radium of an arc of each of the variable resistance patterns VR1 and VR2 depending on a magnitude of a voltage applied, so that a decrease in area of the circuit board is subject to restriction.

SUMMARY OF THE INVENTION

The present invention has been made in view of the foregoing disadvantage of the prior art.

Accordingly, it is an object of the present invention to provide a high-voltage variable resistor which is capable of reducing a size of a circuit board for the resistor as compared with the prior art.

It is another object of the present invention to provide a high-voltage variable resistor which is capable of being significantly small-sized as compared with the prior art.

It is a further object of the present invention to provide a high-voltage variable resistor which is capable of facilitating taking-out of an output thereof while ensuring small-sizing of the resistor as compared with the prior art.

In the conventional high-voltage variable resistor, the connection pattern acting as the electrical connection means is formed on the front surface of the circuit board and a part (contact) of the slide element is contacted with the end of the connection pattern. Thus, such construction of the conventional high-voltage variable resistor causes a contact point between the electrical connection means and the slide element to be defined on the front surface of the circuit board.

On the contrary, a high-voltage variable resistor of the present invention is so constructed that a contact point between an electrical connection means and a slide contact is defined so as to be apart from a front surface of a circuit board, resulting in being located in a space. Such construction prevents the contact point between the electrical connection means and the slide element from being defined at a central portion of the variable resistance pattern, so that a radius of curvature of the variable resistance pattern may be significantly reduced as compared with that in the prior art. This permits a circuit pattern formed on the front surface of the circuit board to be small-sized, leading to small-sizing of the high-voltage variable resistor.

In accordance with the present invention, a high-voltage variable resistor is provided, which generally includes a circuit board having at least one variable resistance pattern provided on a front surface thereof, a slide element including a slide contact slid on the variable resistance pattern, an operation shaft member on which the slide element is operably mounted, and an electrical connection means contacted with a part of the slide element to establish electrical connection between the slide element and an output portion of the electrical connection means.

In the present invention, the electrical connection means and slide element are constructed so that a contact point between the electrical connection means and the slide element is defined on a side of the operation shaft member in a manner to be spaced from the front surface of the circuit board. From a point of view of a design, the electrical connection means and slide element may be constructed so as to render a maximum potential difference between the electrical connection means and slide element and the variable resistance pattern smaller than a discharge occurrence potential difference.

In the present invention, the slide element basically includes an arm portion for supporting the slide contact and mount portions for mounting the arm portion on the operation shaft member. In the prior art, the slide element includes a contact contacted with the connection pattern. The slide element of the present invention is highly different in construction from that of the prior art, because the former is free of such a contact as in the prior art. Also, in the present invention, the slide element includes the mount portions including the contact portion contacted with the contact portion of the electrical connection means, unlike the slide element of the prior art. Thus, in the present invention, the mount portions of the slide element include the contact portion with which the contact portion of the electrical connection means is contacted. The contact portion of the electrical connection means and the contact portion of the slide element are arranged so as to ensure smooth operation of the slide element.

The electrical connection means may be constructed in any desired manner. Basically, it includes a contact portion contacted with a part (contact portion) of the mount portions of the contact element at a position apart from the front surface of the circuit board, a contact holding portion for holding the contact portion at a position apart from the front surface of the circuit board, and a positioning portion for positioning the contact holding portion with respect to the circuit board. When the output portion is arranged on a side of the rear surface of the circuit board, the contact holding portion is arranged so as to extend from a side of the front surface of the circuit board toward the mount portions of the slide element in a space. In this instance, the variable resistance pattern may be arranged at a part thereof below the contact holding portion extending in a space. Thus, the contact holding portion may be arranged so as to pass over the variable resistance pattern while being spaced therefrom. In this instance, the electrical connection means is arranged so as to render the maximum potential difference between the electrical connection means and the variable resistance pattern smaller than the discharge occurrent potential difference. The contact holding portion is preferably constructed so as to exhibit elasticity to a degree sufficient to force the contact portion toward a part (contact portion) of the slide element. When the output portion is arranged on the front surface side of the circuit board, the contact holding portion may be supported on the insulating casing.

The positioning portion of the electrical connection means may be constructed in any desired manner. For example, the positioning portion may be fitted in a fitted-on portion formed on the insulating casing, to thereby position the electrical connection means. Alternatively, the positioning portion may be interposedly supported between the insulating casing and the circuit board, to thereby position the electrical connection means. Also, positioning of the electrical connection means may be accomplished by weldedly mounting the positioning portion on an electrode on a circuit pattern formed on the front surface of the circuit board. Further, the positioning may be attained by providing the positioning portion with an interposing mechanism or a clip mechanism and interposingly holding an end of the circuit board in a direction of a width thereof by means of the clip mechanism. Moreover, the positioning may be carried out by forming the circuit board with a through-hole or a groove and loosely or tightly fitting a part of the positioning portion in the through-hole or groove.

The positioning portion not only functions to fixedly position the electrical connection means but may be provided with the output portion of the high-voltage variable resistor in a manner to be integral therewith. The output portion may be constructed in any desired manner. For example, it may be in the form of a terminal to which a lead wire is connected by welding or may be of the type of interposedly holding an outer periphery of a lead wire or pin-like terminal inserted thereinto. Alternatively, it may be constructed into a so-called snap-in structure including a plurality of holding pieces capable of biting into an outer periphery of a pin-like terminal or the like when pulling force is applied thereto. Such construction wherein the output portion is thus provided on the positioning portion in a manner to be integral therewith exhibits advantages of reducing the number of parts to be assembled and the number of steps for assembling. Nevertheless, it is not necessarily required to provide the electrical connection means and output portion in a manner to be integral with each other. Thus, it is possible that the electrical connection means and output portion are formed separately from each other and then connected to each other by means of a suitable connection means such as an engagement structure, a fitting structure or the like.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a high-voltage variable resistor according to the present invention will be described hereinafter with reference to the accompanying drawings.

Figure 1A:
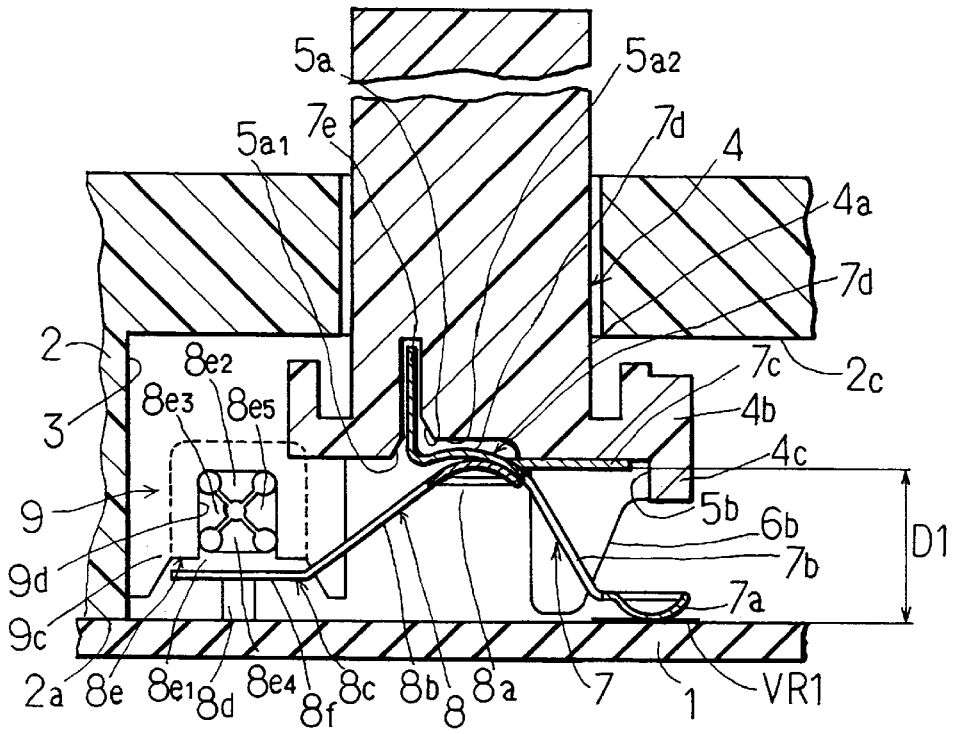
FIG. 1A is a fragmentary schematic sectional view taken along line A—A of FIG. 1B which shows an essential part of an embodiment of a high-voltage variable resistor according to the present invention.
Figure 1B:
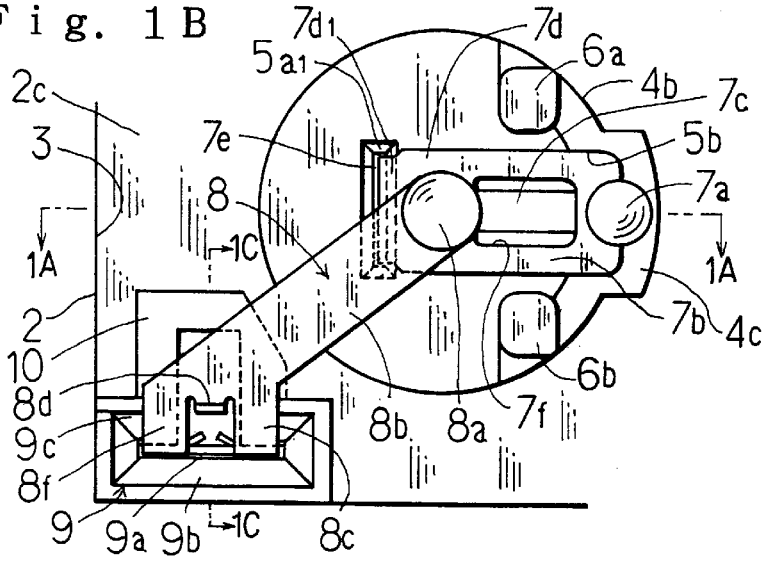
FIG. 1B is a schematic bottom view showing an essential part of the high-voltage variable resistor of FIG. 1A, from which a circuit board is omitted for the sake of brevity.
Figure 1C:
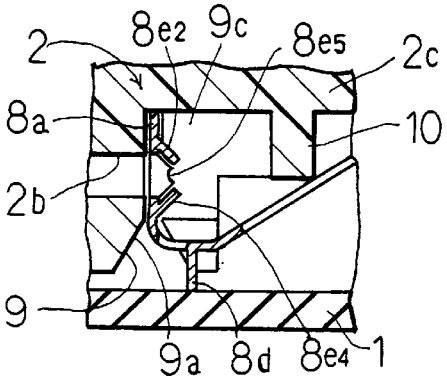
FIG. 1C is a fragmentary sectional view taken along line C—C of FIG. 1B.
Figure 2A:
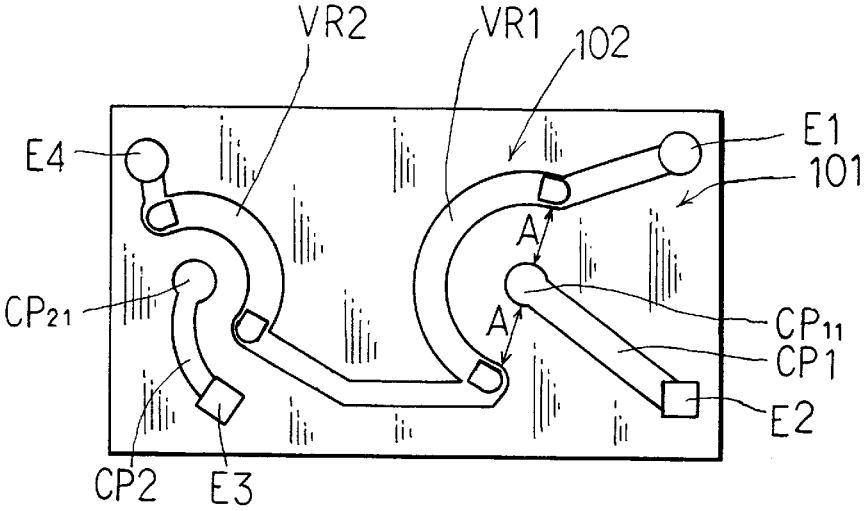
Fig. 2A PRIOR ART
FIG. 2A is a plan view showing a circuit board incorporated in a conventional high-voltage variable resistor.
Figure 2B:
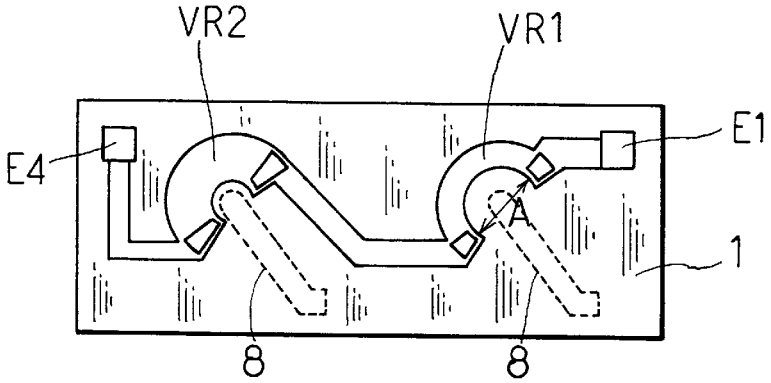
FIG. 2B is a plan view showing a circuit board incorporated in the high-voltage variable resistor shown in FIG. 1A, wherein the circuit board is shown at the same magnification as that of FIG. 2A.

Referring first to FIGS. 1A to 1C, an embodiment of a high-voltage variable resistor according to the present invention is illustrated. A high-voltage variable resistor of the illustrated embodiment includes a circuit board 1 made of a ceramic material and provided on a front surface thereof with a circuit pattern including at least one variable resistance pattern. Reference numeral 2 designates an insulating casing made of an insulating resin material and including an opening at one end thereof. The insulating casing 2 is provided therein with a receiving chamber 3 in which the circuit board 1, a slide element described hereinafter and the like are received. The circuit board 1 is joined to a rib 2*a* of the insulating casing 2 by means of an adhesive. The rib 2*a* may be formed on the insulating casing 2 so as to surround the receiving chamber 3. The circuit pattern formed on the front surface of the circuit board 1 is constructed as shown in FIG. 2B. More particularly, the circuit pattern includes an input electrode E1, a ground electrode E4, a first variable resistance pattern VR1 for adjustment or variation of a focus voltage, and a second variable resistance pattern VR2 for adjustment or variation of a screen voltage. FIG. 2A is a plan view showing a circuit board 101 incorporated in a conventional high-voltage variable resistor and is prepared at the same magnification as FIG. 2B. As will be noted from comparison of FIG. 2B with FIG. 2A, the circuit board 1 incorporated in the high-voltage variable resistor of the illustrated embodiment is reduced in width to a level about two third as large as the circuit board 101 incorporated in the conventional high-voltage variable resistor. Also, the circuit board 101 in the conventional high-voltage variable resistor, as shown in FIG. 2A, is provided thereon with a focus voltage output electrode E2, a screen voltage output electrode E3, and a connection pattern connected to each of the electrodes E2 and E3. On the contrary, the circuit board 1 in the illustrated embodiment is free of such electrodes and connection pattern. Such a difference in construction between the illustrated embodiment and the prior art is due to the fact that such a novel output structure as detailedly described hereinafter is incorporated in the illustrated embodiment.

In FIGS. 1A and 1B, reference numeral 4 designates an operation shaft member, which includes a shaft portion 4*a* arranged so as to extend through an upper portion (not shown) of the insulating casing 2 and a slide element positioning portion 4*b* of a large diameter formed integrally with the shaft portion 4*a* and arranged in the receiving chamber 3. The slide element positioning portion 4*b* of the operation shaft member 4 is formed on an end surface thereof facing the circuit board 1 with a fitted-on hole 5*a* acting as a slide element fitting-in portion and a fitted-on recess 5*b*. The fitted-on recess 5*b* provides a wall for increasing a creeping distance. For the purpose of forming the fitted-on recess 5*b*, the slide element positioning portion 4*b* is provided on an end surface thereof facing the circuit board 1 with a projection 4*c*, which is integrally provided with two spacer members 6*a* and 6*b* in a manner to be projected therefrom toward the circuit board 1. The spacer members 6*a* and 6*b* function to regulate movement of the operation shaft member 4 toward the circuit board 1 so as to prevent excessive compression of a slide element 7 during operation of the operation shaft member 4.

The slide element 7 is made of a plate material of metal such as stainless steel, phosphor bronze or the like by working. The slide element 7 includes an arm portion 7*b* provided at a distal end thereof with a slide contact 7*a* slid on the variable resistance pattern, a plate-like portion 7*c* extending along the above-described end surface of the slide element positioning portion 4*b*, a contact portion 7*d* with which a contact portion 8*a* of a terminal fitment 8 constituting or acting as an electrical connection means, and a raised portion 7*e* extending from one end of the contact portion 7*d* in a direction perpendicular to a direction of extension of the plate-like portion 7*c* and apart from the circuit board 1 or in a direction perpendicular to a plane of the circuit board 1 and apart from the circuit board 1. The arm section 7*b* is formed at a central position thereof with an elongate through-hole 7*f*, which is a punched hole formed in the plate-like portion 7*c* by punching when the slide element 7 is formed of a single metal plate by working. The contact portion 7*d* is provided at a central portion thereof with a curved portion 7*d*1, which is formed into a bowl-like shape or a shape in which a rear surface thereof facing the circuit board 1 is outwardly projected. The curved portion 7*d*1 may be formed by pressing. Assembling of the high-voltage variable resistor of the illustrated embodiment is carried out while keeping a rear surface of the insulating casing 1 upward. Then, the operation shaft member 4 is inserted through the above-described opening of the receiving chamber 3 into the chamber 3. Then, the slide element 7 is inserted through the opening of the receiving chamber 3 into the receiving chamber 3 so that the raised portion 7*e* of the slide element 7 is inserted into a vertical portion 5*a*1 of the fitted-on hole 5*a*, the contact portion 7*d* of the slide element 7 is projected into a horizontal portion 5*a*2 of the fitted-on hole 5*a* and the plate-like portion 7*c* of the slide element 7 is fitted at a distal end thereof in the fitted-on recess 5*b*.

The above-described terminal fitment 8 acting as the electrical connection means includes an arm-like contact holding portion 8*b* provided at one end thereof with a contact portion 8*a* and a positioning portion 8*c* connected to the other end of the contact holding portion 8*b*. The contact holding portion 8*b* is bent at a connection thereof to the positioning portion 8*c* in a manner to be gradually apart from the front surface of the circuit board 1 as it approaches to the contact portion 8*a*. In the illustrated embodiment, the contact holding portion 8*b* of the terminal fitment 8 and the arm portion 7*b* of the slide element 7 cooperate with each other to support the operation shaft member 4. This results in a contact point between the contact portion 8*a* of the contact holding portion 8*b* of the terminal fitment 8 and the contact portion 7*d* of the slide element 7 being defined at a position apart by a distance D1 from the front surface of the circuit board 1.

A construction of the terminal fitment 8 and slide element 7 and more particularly a configuration and dimensions thereof are so defined that a maximum potential difference between the terminal fitment 8 and slide element 7 and the variable resistance pattern VR1 is rendered smaller than a discharge occurrence potential difference. In the illustrated embodiment, the maximum potential difference possibly occurs between a proximity to the curved portion or corner 7*d*1 of the contact portion 7*d* of the slide element 7 and a minimum potential portion of the variable resistance pattern VR1.

The positioning portion 8*c* of the terminal fitment 8 includes a connection conductor holding portion 8*e* for holing a connection conductor such as a core of a lead wire, an end of a pin-like terminal or the like which is inserted from an exterior of the insulating casing 2 through a through-hole 2*b* of a wall of the insulating casing 2 thereinto, as well as a connection portion 8*f* for establishing connection between the connection conductor holding portion 8*e* and the contact holding portion 8*b*. The connection conductor holding portion 8*e* includes a plate-like portion 8*e*1 of a substantially rectangular shape, which is formed with a cross-shaped slit, resulting in four holding pieces 8*e*2 to 8*e*5 being provided. The holding pieces 8*e*2 to 825 each are cut at a distal end thereof into an arcuate shape, so that a tip of the distal end of each of the holding pieces 8*e*2 to 8*e*5 is formed with two acute corners and the cross-shaped slit is formed at a central portion thereof with a circular hole. The circular hole of the cross-shaped slit functions to adjust elastic force of each of the holding pieces 8*e*2 to 8*e*5. The four holding pieces 8*e*2 to 8*e*5 each are obliquely formed so that a distal end thereof is projected in a direction of insertion of the connection conductor into the connection conductor holding portion 8*e*, resulting in biting into an outer periphery of the connection conductor to prevent the connection conductor from being detached from the connection conductor holding portion 8*e* when pulling force in a direction opposite to the direction of insertion of the connection conductor is applied to the connection conductor.

The connection conductor holding portion 8*e* is fitted in a fitted-on recess 9*a* of a projection 9 provided on an upper wall of the insulating casing 2. The projection 9 includes a first wall portion 9*b* arranged adjacently to a side wall of the insulating casing 2, which wall portion 9*b* is formed with the above-described through-hole 2*b*. Also, the projection 9 includes a second wall portion 9*c* arranged opposite to the first wall portion 9*b*, which wall portion 9*c* is formed with a window 9*d*. The connection conductor inserted through the connection conductor holding portion 8*e* is then inserted through the window 9*d*. The connection conductor thus inserted through the connection conductor holding portion 8*e* and window 9*d* is abutted at a distal end thereof against a stopper wall 10 formed at the insulating casing 2 adjacently to the second wall portion 9*c* of the projection 9 as shown in FIGS. 1B and 1C. The stopper wall 10 is omitted from FIG. 1A for the sake of brevity. The stopper wall 10 functions to prevent excessive insertion of the connection conductor.

The terminal fitment 8 also includes a leg portion 8*d* raised from the connection portion 8*f* of the positioning portion 8*c* toward the circuit board 1. FIGS. 1A and 1C show that the leg portion 8*d* is arranged in a manner to be perpendicular to the front surface of the circuit board 1. Actually, it is preferable that the leg portion 8*d* is obliquely arranged so as not to be perpendicular to the front surface of the circuit board. Such arrangement of the leg portion 8*d* leads to deformation of the connection portion 8*f* about the leg portion 8*d*, to thereby permit the positioning portion 8*c* to be firmly interposedly supported between the circuit board 1 and the insulating casing 2.

In the illustrated embodiment, the terminal fitment 8 acting as the electrical connection means is so constructed that the positioning portion 8*c* is formed integrally with the connection conductor holding portion 8*e*. Such construction decreases the number of parts of the terminal fitment 8 and therefore the high-voltage variable resistor and facilitates assembling of the resistor.

Figure 3:
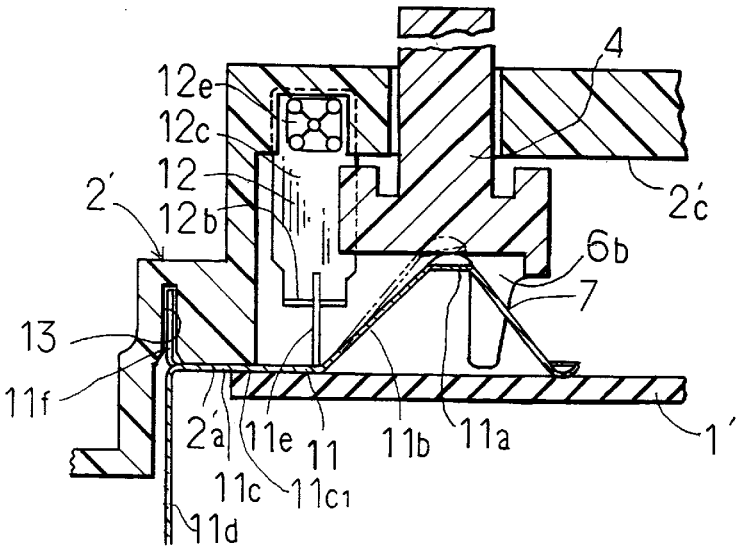
FIG. 3 is a fragmentary schematic sectional view showing an essential part of another embodiment of a high-voltage variable resistor according to the present invention.
Figure 6A:
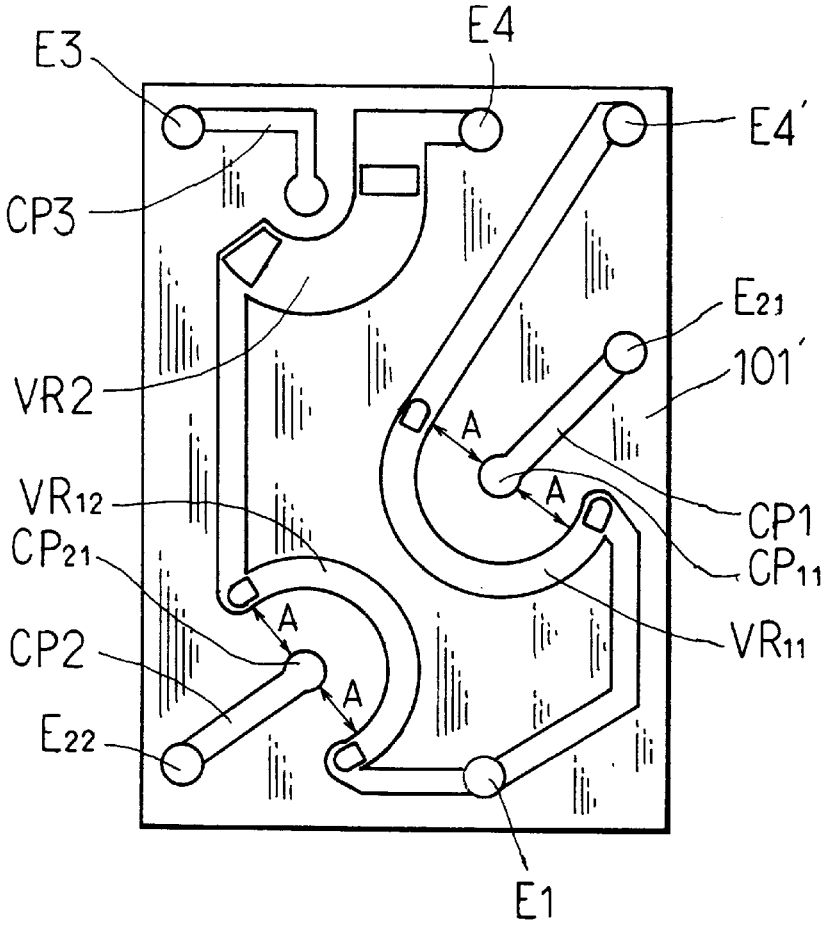
Fig. 6A PRIOR ART
FIG. 6A is a plan view showing a circuit board incorporated in a conventional high-voltage variable resistor.

Referring now to FIG. 3, another embodiment of a high-voltage variable resistor according to the present invention is illustrated, in which an output structure of the present invention is applied to one focus output from a circuit board of a focus pack of the so-called double focus type. Parts in the embodiment of FIG. 3 corresponding to those in the above-described embodiment are designated at like reference characters or like reference characters having a dash put thereafter. As will be noted from comparison between FIG. 6A which is a plan view showing a circuit board 101' incorporated in a conventional high-voltage variable resistor and FIG. 6B which is a plan view showing a circuit board 1' incorporated in the high-voltage variable resistor of FIG. 3 wherein the circuit board is shown at the same magnification as that of FIG. 6A; the circuit board 1' incorporated in the illustrated embodiment is reduced in area to a degree about one half as large as the conventional one 101'. Also, the circuit board 101' in the conventional high-voltage variable resistor, as shown in FIG. 6A, is provided thereon with focus voltage output electrodes E21 and E22, a screen voltage output electrode E3, and a connection pattern connected to each of the electrodes E2 and E3. On the contrary, the circuit board 1' in the illustrated embodiment is free of such electrodes and connection pattern. Such a difference in construction between the illustrated embodiment and the prior art is due to the fact that such a novel output structure as detailedly described hereinafter is incorporated in the illustrated embodiment.

Figure 4A:
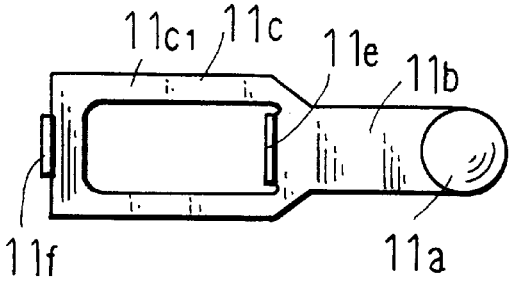
FIG. 4A is a plan view showing a terminal fitment.
Figure 4B:
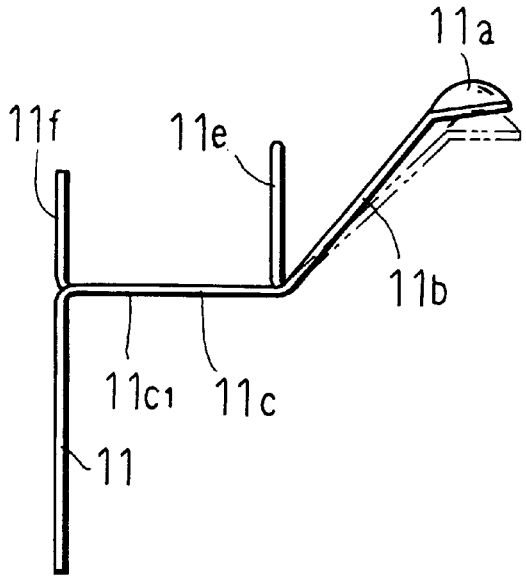
FIG. 4B is a front elevation view of the terminal fitment shown in FIG. 4A.
Figure 4C:
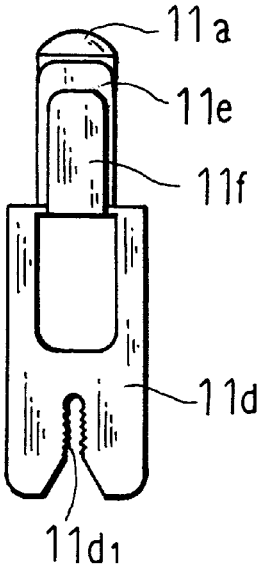
FIG. 4C is a left side elevation view of the terminal fitment shown in FIG. 4A.

In the output structure shown in FIG. 3, a terminal fitment 11 constituting or acting as an electrical connection means is combined with an output terminal fitment 12. The terminal fitment 11 is provided with a terminal portion for connecting a lead wire of a capacitor arranged on a side of a rear surface of the circuit board 1' to a focus output terminal. FIGS. 4A to 4C are a plan view, a front elevation view and a left side elevation view showing the terminal fitment 11, respectively. The terminal fitment 11 includes an arm-like contact holding portion 11*b* having a contact portion 11*a* provided at one end thereof and contacted with a rear surface of a contact portion (not shown) of a slide element 7, a positioning portion 11*c* connected to the other end of the contact holding portion 11*b*, and a terminal portion 11*d* integrally provided on an end of the positioning portion 11*c*. The contact holding portion 11*b* is bent at a connection thereof to the positioning portion 11*c* in a manner to be gradually apart from a front surface of the circuit board 1' as it approaches to the contact portion 11*a*.

The positioning portion 11*c* includes a plate-like portion 11*c*1 contacted with the front surface of the circuit board 1'. Reference character 11*e* is a connection portion raised from the plate-like portion 11*c*1 in a direction apart from the circuit board 1'. The output terminal fitment 12 is connected to the connection portion 11*e* through a fitting structure. Also, the plate-like portion 11*c*1 is provided with a fitted-in portion 11*f* in a manner to extend from the terminal portion 11*d* in a direction apart from the circuit board 1'. The fitted-in portion hlf is fitted in a fitted-on recess formed on a side wall of an insulating casing 2'. The terminal fitment 11 is so arranged that the plate-like portion 11*c*1 of the positioning portion 11*c* is interposedly supported between the front surface of the circuit board 1' and a rib 2'*a* of the insulating casing 2'. The insulating casing 2' is formed with an opening, through which epoxy insulating resin is charged in the insulating casing 1', so that the circuit board 1' is formed on the rear surface thereof with an insulating resin layer. The terminal portion 11*d* of the terminal fitment 11, as shown in FIG. 4C, is formed with a lead wire engagement groove 11*d*1, of which an inner periphery is rugged, resulting in biting into an outer periphery of a lead wire. The lead wire is embedded at an end thereof in resin for molding of a fly-back transformer while being engagedly fitted in the lead wire engagement groove 11*d*1. This eliminates a necessity of connection between the lead wire and the terminal portion 11*d* by soldering.

Figure 5A:
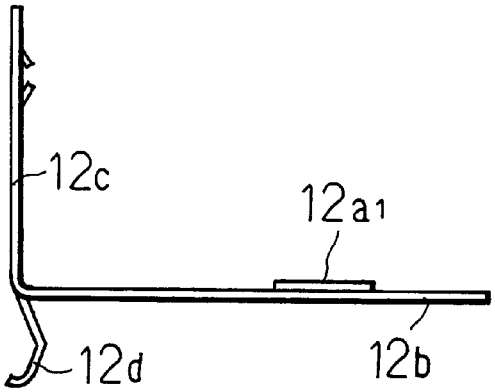
FIG. 5A is a front elevation view showing an output terminal fitment.
Figure 5B:
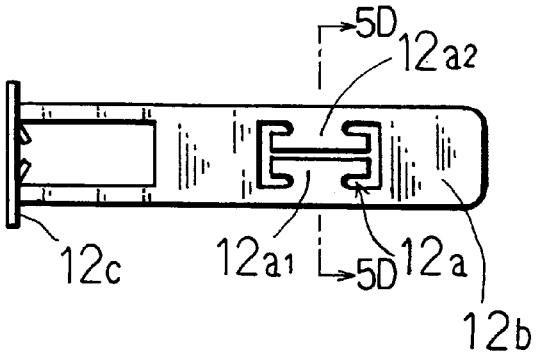
FIG. 5B is a plan view of the output terminal fitment shown in FIG. 5A.
Figure 5C:
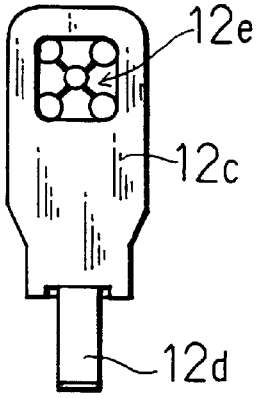
FIG. 5C is a left side elevation view of the output terminal fitment shown in FIG. 5A.
Figure 5D:
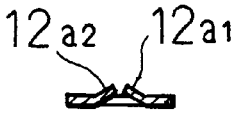
FIG. 5D is a sectional view taken along line D—D of FIG. 5B.

The output terminal fitment 12 connected to the connection portion 11*e* of the terminal fitment 11 is constructed in such a manner as shown in FIGS. 5A to 5C. As will be noted from FIG. 6B, two focus outputs are outwardly led out of one terminal side of the circuit board 1' defined in a longitudinal direction thereof. In this instance, one terminal fitment having a connection conductor holding portion may be used as in the embodiment described above with reference to FIG. 1. Unfortunately, formation of a single metal plate into one terminal fitment including such a connection conductor holding portion causes waste of the material to be significantly increased. Also, this requires to prepare two separate terminal fitments of a symmetric configuration for the two focus outputs. Thus, in the illustrated embodiment, a combination of the terminal fitment 11 for the electrical connection means and the output terminal fitment 12 is employed for the purpose of both material-saving and common use of the parts.

As shown in FIG. 3 and FIGS. 5A to 5C, the output terminal fitment 12 includes a first plate-like portion 12*b* including a fitted-on portion 12*a* in which the connection portion 11*a* of the terminal fitment 11 is fitted, a second plate-like portion 12*c* extending from one end of the first plate-like portion 12 in a direction perpendicular to the plate-like portion 12*b*, and a leg portion 12*d*. The fitted-on portion 12*a* includes two holding pieces 12*a*1 and 12*a*2 formed by punching of the plate-like portion 12*b*. The two holding pieces 12*a*1 and 12*a*2 are adapted to interposedly hold both sides of the connection portion 11*e* of the terminal fitment 11 defined in a direction of a thickness thereof therebetween. The second plate-like portion 12*c* is formed with a connection conductor holding section portion 12*e* for holding an end of a connection conductor such as a lead wire or the like externally inserted into the insulating casing 2'. The connection conductor holding portion 12*e* may be constructed in substantially the same manner as the connection conductor holding portion 8*e* of the terminal fitment 8 described above with reference to FIG. 1. The leg portion 12*d* is formed so as to extend from the first plate-like portion 12*b* toward the circuit board 1'. The leg portion 12*d* is subject to bending, resulting in exhibiting elasticity. The insulating casing 2' is formed on an inner surface thereof with a projection in substantially the same manner as the projection 9 shown in FIG. 1, in which the connection conductor holding portion 12*e* of the second plate-like portion 12*c* is fitted, so that elasticity of the leg portion 12*d* permits the output terminal fitment 12 to be interposedly supported between the front surface of the circuit board 1' and the insulating casing 2'.

Separate formation of the terminal fitment 11 and output terminal fitment 12 independent from each other for the two focus outputs in the illustrated embodiment minimizes waste of the material, because both terminal fitments can be readily prepared by shifting an angle by 180 degrees. A screen output terminal structure may be constructed in substantially the same manner as in FIGS. 1A to 1C or 3.

Figure 6B:
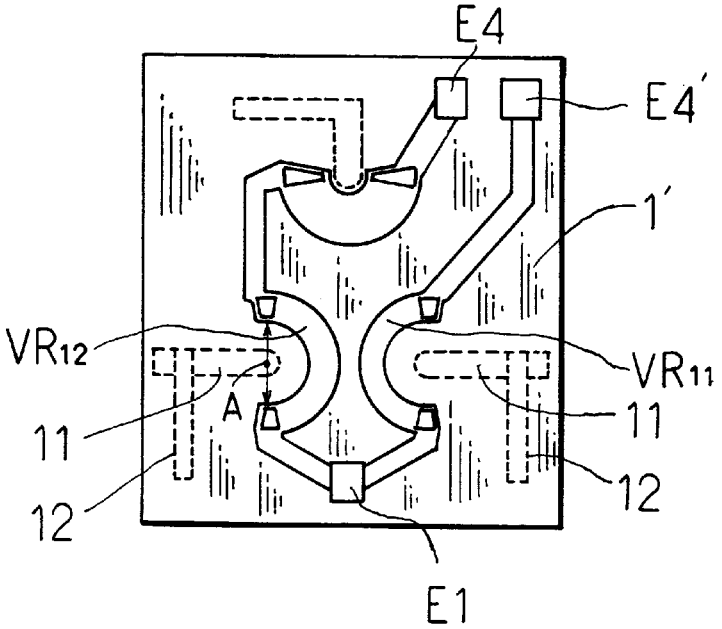
FIG. 6B is a plan view showing a circuit board incorporated in the high-voltage variable resistor shown in FIG. 3, wherein the circuit board is shown at the same magnification as that of FIG. 6A.

As will be noted from comparison between FIG. 6A and FIG. 6B, the illustrated embodiment likewise permits variable resistance patterns VR11, VR12 and VR2 to be substantially reduced in diameter because each of the variable resistance patterns is not formed at a central portion thereof with any conductive portion. More specifically, the illustrated embodiment permits an inner diameter of each of the variable resistance patterns VR11, VR12 and VR2 to be reduced to a level equal to a distance A between ends CP11, CP21 of connection patterns CP1, CP2 and the variable patterns VR11, VR12. This results in an area of the circuit board 1' being substantially decreased, leading to a substantial decrease in dimensions of the high-voltage variable resistor.

The remaining part of the illustrated embodiment may be constructed in substantially the same manner as the above-described embodiment.

Figure 7A:
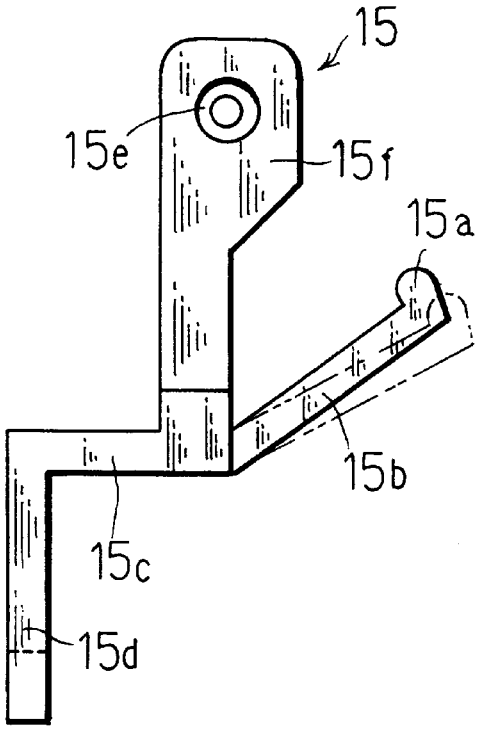
FIG. 7A is a schematic front elevation view showing a connection conductor made of a conductive plastic material.
Figure 7B:
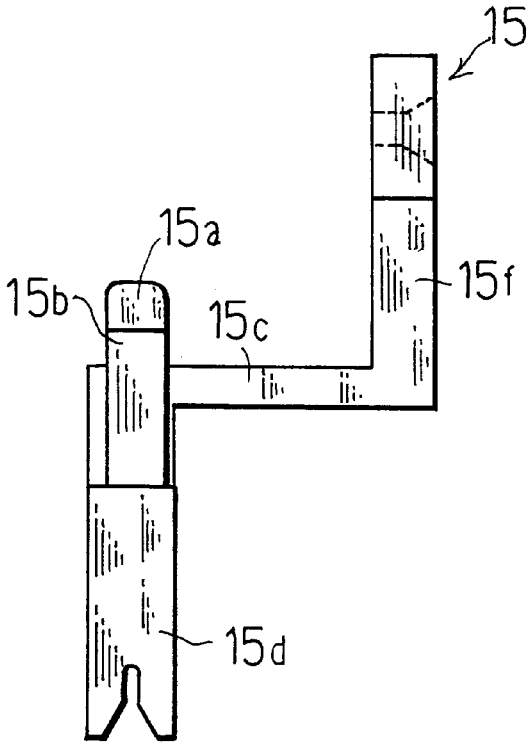
FIG. 7B is a right side elevation view of the connection conductor of FIG. 7A.
Figure 7C:
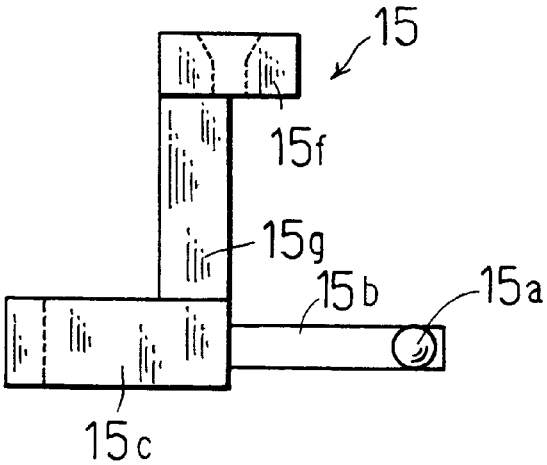
FIG. 7C is a plan view of the connection conductor shown in FIG. 7A.

In each of the embodiments described above, the terminal fitment 8 or 11 acting as the electrical connection means is made of metal and the slide element 7 is likewise made of metal. Thus, the electrical connection means can be provided readily and at a reduced cost. The contact portions 7*d*, 8*a* and 11*a* each may be coated with a conductive resin paint such as a carbon paint. Also, at least one of the electrical connection means and slide element may have the contact portion made of a conductive plastic material or a conductive rubber material. FIGS. 7A to 7C show an example of such an electrical connection means made of a conductive plastic material. The electrical connection section generally designated at reference numeral 15 includes a contact holding portion 15*b* including a contact portion 15*a*, a positioning portion 15*c* interposedly held between the circuit board and the insulating casing, a terminal portion 15*d* led out to a rear surface side of the circuit board, a terminal portion 15*f* including a connection conductor holding portion 15*e* in which an end of the connection conductor is pressedly fitted, and a connection portion 15*g* for connecting the terminal portion 15*f* to the positioning portion 15*c*. Formation of a conductive plastic material into the electrical connection means including the connection conductor holding portion permits it to be made by injection molding, leading to material-saving.

In embodiments described above, the output structure of the present invention is applied to all the output structures. Alternatively, the conventional output structure may be applied to a part of the output structures of each of the embodiments.

Also, in each of the embodiments, the connection conductor is not connected directly to the circuit board. Alternatively, it may be constructed, for example, in such a manner that an output electrode is arranged on the circuit board and then connected to the positioning portion of the terminal fitment acting as the connection conductor by soldering, resulting in the connection conductor being connected directly to the circuit board. Further, the embodiments each may be so constructed that a conductive rubber material is arranged between the circuit board and the insulating casing and a plug-in portion provided at the positioning portion of the terminal fitment acting as the connection conductor is fitted in the conductive rubber material to position the connection conductor. Then, the output terminal is inserted into the conductive rubber material via a through-hole of the circuit board.

In addition, in each of the embodiments, the contact portion 8*a* of the terminal fitment 8 is positioned on a central axis of the operation shaft member 4. Alternatively, the contact portion 8*a* of the terminal fitment 8 and the contact portion 7*d* of the slide element 7 may be contacted with each other at a position radially outwardly apart from the central axis of the operation shaft member 4. In this instance, the contact portion 7*d* of the slide element 7 may be formed into an arcuate shape or a semicircular shape so that it may turn around the central axis of the operation shaft member 4.

Furthermore, in each of the embodiments, the positioning portion of the terminal fitment is arranged on an inside of an arc of the variable resistance pattern. Alternatively, it is a matter of course that the positioning portion may be arranged on an outside of the arc. In this instance, the contact holding portion is permitted to pass over a part of the variable resistance pattern at an interval therebetween. In this instance, the maximum potential difference between the terminal fitment acting as the electrical connection means and the variable resistance pattern is likewise rendered smaller than the discharge occurrence potential difference. Also, the contact holding portion of the terminal fitment may be arranged so as to be located on an inner surface of the insulating casing opposite to the front surface of the circuit board.

Moreover, in each of the embodiments, the circuit board is formed on the rear surface thereof with the insulating resin layer. Alternatively, the high-voltage variable resistor may be so constructed that the opening of the receiving chamber 3 of the insulating casing 2 is closed with a 11*d* or cover member without formation of the insulating resin layer. Also, combination of the high-voltage variable resistor of each of the embodiments with a transformer casing of a fly-back transformer permits the fly-bacic transformer to be decreased in dimension as compared with the prior art.

As can be seen from the foregoing, the high-voltage variable resistor of the present invention is so constructed that contact between the electrical connection means and the slide element is carried out at a location spaced from the front surface of the circuit board. Such construction prevents the contact point between the electrical connection means and the slide element from being defined at the central portion of the variable resistance pattern, so that a radius of curvature of the variable resistance pattern may be significantly reduced as compared with that in the prior art. This permits the circuit pattern formed on the front surface of the circuit board to be small-sized, leading to small-sizing of the high-voltage variable resistor.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A high-voltage variable resistor comprising:

a circuit bard provided on a front surface thereof with a printed resistance element including at least one variable resistance arcuate pattern;

a insulating casing receiving said circuit board therein:

a slide element including a slide contact slidable on said variable resistance pattern;

an operation shaft member including a shaft portion rotatably inserted through said insulating casing and being arranged on a side of said front surface of said circuit board and on which said slide element is mounted; and an electrical connection means contacted with a part of said slide element to establish electrical connection between said slide elements and an output portion of said electrical connection means;

said slide element including an arm portion supporting said slide contact and mount portions mounting said arm portion on said operation shaft member;

said electrical connection means including a contact portion contacted with a part of said mount portions of said contact element at a position apart from said front surface of said circuit board;

a contact holding portion connected to said contact portion at one end thereof holding said contact portion at a position apart from said front surface of said circuit board, and a positioning portion positioning the other end of said contact holding portion with respect to said circuit board, at a position apart from a center of an arc of the variable resistance pattern and a region between the center and the variable resistance pattern;

said electrical connection means providing a maximum potential difference between said electrical connection means and said variable resistance pattern smaller than a discharge potential difference said slide element being rotatable about the contact portion of the electrical connection means.

* * * * *

UNITED STATES PATENT AND TRADEMARK OFFICE

CERTIFICATE OF CORRECTION

PATENT NO. : 5,933,070

DATED : August 3, 1999

INVENTOR(S) : Hasebe et al.

It is certified that error appears in the above-identified patent and that said Letters Patent is hereby corrected as shown below:

Column 6, Line 50, delete "825" and insert --8e5--.

Column 8, Line 26, delete "hlf" and insert --11f--.

Column 10, Line 59, delete "11d" and insert --lid--.

Column 10, Line 63, delete "fly-bacic" and insert --fly-back--.

Column 11, Line 20, Claim 1, delete "bard" and insert --board--.

Signed and Sealed this

Fourteenth Day of December, 1999

*Attest:*

*Attesting Officer*

Q. TODD DICKINSON

*Acting Commissioner of Patents and Trademarks*